US011572883B2

(12) United States Patent
Yamazaki

(10) Patent No.: US 11,572,883 B2
(45) Date of Patent: Feb. 7, 2023

(54) REVERSIBLE FAN

(71) Applicant: SANYO DENKI CO., LTD., Tokyo (JP)

(72) Inventor: Yoshihisa Yamazaki, Tokyo (JP)

(73) Assignee: SANYO DENKI CO., LTD., Tokyo (JP)

( * ) Notice: Subject to any disclaimer, the term of this patent is extended or adjusted under 35 U.S.C. 154(b) by 0 days.

(21) Appl. No.: 17/734,173

(22) Filed: May 2, 2022

(65) Prior Publication Data

US 2022/0364567 A1 Nov. 17, 2022

(30) Foreign Application Priority Data

May 12, 2021 (JP) ..... JP2021-081096

(51) Int. Cl.
*F04D 19/00* (2006.01)
*F04D 29/66* (2006.01)
*F04D 29/54* (2006.01)

(52) U.S. Cl.
CPC ..... *F04D 19/005* (2013.01); *F04D 29/547* (2013.01); *F04D 29/667* (2013.01)

(58) Field of Classification Search
CPC .... F04D 19/005; F04D 25/0613; F04D 25/08; F04D 29/547; F04D 29/667
See application file for complete search history.

(56) References Cited

U.S. PATENT DOCUMENTS 6,388,196 B1 5/2002 Liu et al.
6,572,333 B2 * 6/2003 Fujinaka ..... F04D 25/0613 415/222
8,616,864 B2 * 12/2013 Nakamura ..... F04D 29/52 174/97
10,260,519 B2 * 4/2019 Fujimake ..... F04D 29/325
2005/0180867 A1 8/2005 Takahashi et al.
2008/0100160 A1 5/2008 Shibuya et al.
2018/0087440 A1 3/2018 Yamazaki et al.

FOREIGN PATENT DOCUMENTS

CN 211174698 U 8/2020
JP 2008-115696 A 5/2008
JP 6802022 B2 12/2020

OTHER PUBLICATIONS

Extended European Search Report (EESR) dated Oct. 4, 2022 for European Patent Application No. 22169808.7.

* cited by examiner

*Primary Examiner* — David E Sosnowski
*Assistant Examiner* — Jason G Davis
(74) *Attorney, Agent, or Firm* — Rankin, Hill & Clark LLP

(57) ABSTRACT

Provided is a reversible fan that produces a current of air in both of a normal direction and a reverse direction, the reversible fan including: an impeller configured to be rotatable about a rotation axis; a motor configured to rotate the impeller; a base portion supporting the motor; a tubular frame housing the impeller, the motor, and the base portion; a spoke extending from an inner peripheral surface of the frame toward the rotation axis, the spoke supporting the base portion; and a holding portion configured to hold at least a part of a lead wire provided along the spoke to apply power to the motor, wherein the holding portion is provided with a housing space opening in the reverse direction and extending along the spoke.

8 Claims, 5 Drawing Sheets

REVERSIBLE FAN

CROSS-REFERENCE TO RELATED APPLICATION

This application is based on Japanese Patent Application No. 2021-081096 filed with the Japan Patent Office on May 12, 2021, the entire content of which is hereby incorporated by reference.

BACKGROUND

1. Technical Field

The present disclosure relates to a reversible fan.

2. Related Art

A reversible fan that produces a current of air in the normal direction and the reverse direction is known from, for example, Japanese Patent No. 6802022.

SUMMARY

A reversible fan according to the present embodiment produces a current of air in both of a normal direction and a reverse direction, and includes: an impeller configured to be rotatable about a rotation axis; a motor configured to rotate the impeller; a base portion supporting the motor; a tubular frame housing the impeller, the motor, and the base portion; a spoke extending from an inner peripheral surface of the frame toward the rotation axis, the spoke supporting the base portion; and a holding portion configured to hold at least a part of a lead wire provided along the spoke to apply power to the motor. The holding portion is provided with a housing space opening in the reverse direction and extending along the spoke.

DETAILED DESCRIPTION

Figure 1:
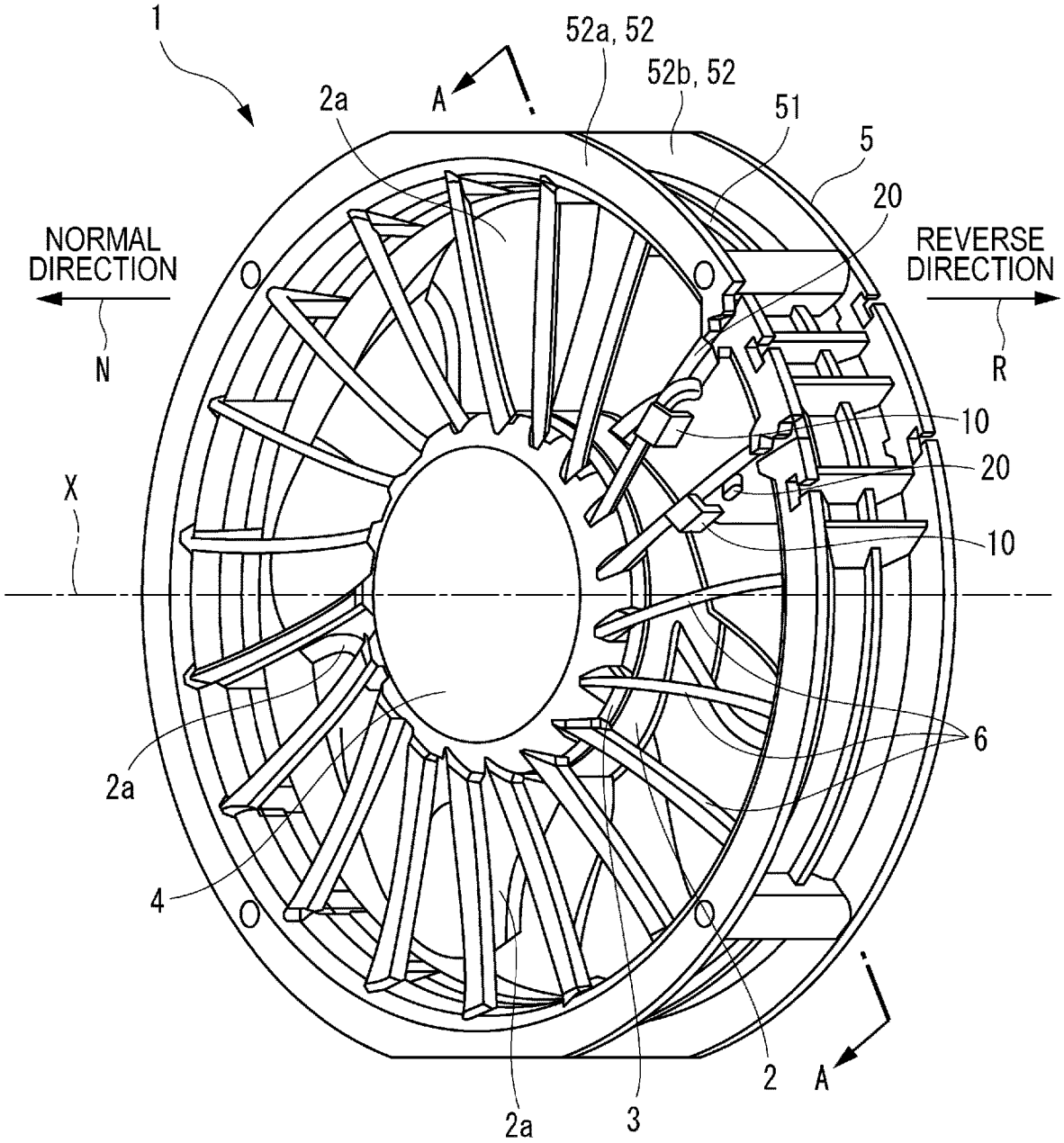
FIG. 1 is a perspective view of a reversible fan according to an embodiment of the present disclosure as viewed from the front.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Such a reversible fan is attached to, for example, the wall of a house. In some cases, the reversible fan is used to draw outside air into the room and increase the room temperature when the outside air is warmer, or discharge the air in the room to the outside and decrease the temperature when the room temperature is high. At this point in time, if the noise generated when the outside air is drawn in is different from the noise generated when the air in the room is discharged, the resident may suspect that the fan is faulty.

Hence, an object of the present disclosure is to provide a reversible fan having noise characteristics upon blowing in the reverse direction, which are close to noise characteristics upon blowing in the normal direction.

A reversible fan according to one aspect of the present disclosure produces a current of air in both of a normal direction and a reverse direction, and includes: an impeller configured to be rotatable about a rotation axis; a motor configured to rotate the impeller; a base portion supporting the motor; a tubular frame housing the impeller, the motor, and the base portion; a spoke extending from an inner peripheral surface of the frame toward the rotation axis, the spoke supporting the base portion; and a holding portion configured to hold at least a part of a lead wire provided along the spoke to apply power to the motor. The holding portion is provided with a housing space opening in the reverse direction and extending along the spoke.

According to the embodiment, it is possible to provide a reversible fan having noise characteristics upon blowing in the reverse direction, which are close to noise characteristics upon blowing in the normal direction.

The embodiment of the present disclosure is described hereinafter with reference to the drawings. Descriptions of members having the same reference numerals as members that have already been described in the detailed description are omitted for the sake of convenience. Moreover, the dimensions of each member illustrated in the drawings may be different from actual dimensions thereof for the convenience of description.

FIG. 1 is a perspective view of a reversible fan 1 according to the embodiment of the present disclosure as viewed from the front. In the following description, the side where wind is discharged when a motor provided to the reversible fan 1 rotates in a counterclockwise direction is referred to as the front side of the reversible fan 1. On the other hand, the side where wind is discharged when the motor rotates in a clockwise direction is referred to as the back side of the reversible fan 1. In the reversible fan 1 illustrated in FIG. 1, the left side is the front side, and the right side is the back side. In the reversible fan 1 illustrated in FIG. 1, the direction pointing to the front side along a direction of a rotation axis X (a direction of an arrow N) is referred to as the "normal direction," and the direction pointing to the back side along the rotation direction X (a direction of an arrow R) is referred to as the "reverse direction."

The reversible fan 1 is a fan that can blow air (produce a current of air) in both of the normal and reverse directions. As illustrated in FIG. 1, the reversible fan 1 includes an impeller 2 that can rotate about the rotation axis X, a motor 3 that rotates the impeller 2, a base portion 4 that supports the motor 3, and a tubular frame 5 where these members are housed. The impeller 2, the motor 3, and the base portion 4 are provided in such a manner as to overlap along the direction of the rotation axis X.

The impeller 2 is formed in a substantially cup shape. A plurality of blades 2*a* is radially attached to the perimeter of the impeller 2. The blades 2*a* attached to the impeller 2 are provided in such a manner as to be inclined relative to an axial direction (the same direction as the rotation axis X) of a rotating shaft portion of the reversible fan 1. With the rotation of the blades 2*a*, the impeller 2 produces a current of air in the normal or reverse direction.

The motor 3 is provided in the impeller 2. The motor 3 is configured as, for example, an outer rotor brushless motor. The motor 3 includes a stator, and a rotor that is placed outward of the stator. The rotor portion of the motor 3 in the impeller 2 is fixed to the impeller 2. The motor 3 is assembled in the impeller 2 in such a manner as to be placed on the front side (the normal direction side) relative to the impeller 2.

The base portion 4 is formed in the form of, for example, a circular cup. The base portion 4 is provided in such a manner as to cover the normal direction side of the motor 3. The base portion 4 supports the stator portion of the motor 3. The base portion 4 is assembled in the frame 5 in such a manner as to be placed on the front side relative to the motor 3.

The base portion 4 is supported by a plurality of spokes 6. The spokes 6 are provided in such a manner as to extend from an inner peripheral surface of the frame 5 toward the rotation axis X, and are connected to a peripheral portion of the base portion 4. In other words, the spokes 6 extend radially in the radial direction from the peripheral portion of the base portion 4, and are connected to the inner peripheral surface of the frame 5. The base portion 4 supported by the spokes 6 is attached at a position close to the front side of the tubular frame 5 extending along the rotation axis X (to the front side of the reversible fan 1).

The spokes 6 that support the base portion 4 have a flat cross-sectional shape. The cross-sectional shape extends in a direction substantially along the rotation axis X, that is, a direction in which a current of air produced flows. The spoke 6 is formed in such a manner as to have a small surface area as viewed in the direction of the rotation axis X. The spoke 6 is provided with a holding portion 10 and a retaining portion 20 for holding a lead wire (illustration omitted) that supplies power to the motor 3. The holding portion 10 and the retaining portion 20 are provided to a predetermined spoke 6 at a position where the lead wire is placed. In the example, two spokes 6 are each provided with the holding portion 10 and the retaining portion 20.

The frame 5 includes a main body portion 51 forming the tubular part, and a flange portion 52 (52*a* and 52*b*) provided on an outer region of each end of the main body portion 51.

Next, the holding portion 10 and the retaining portion 20, which are provided to the spoke 6, are described with reference to FIGS. 2 to 4.

Figure 2:
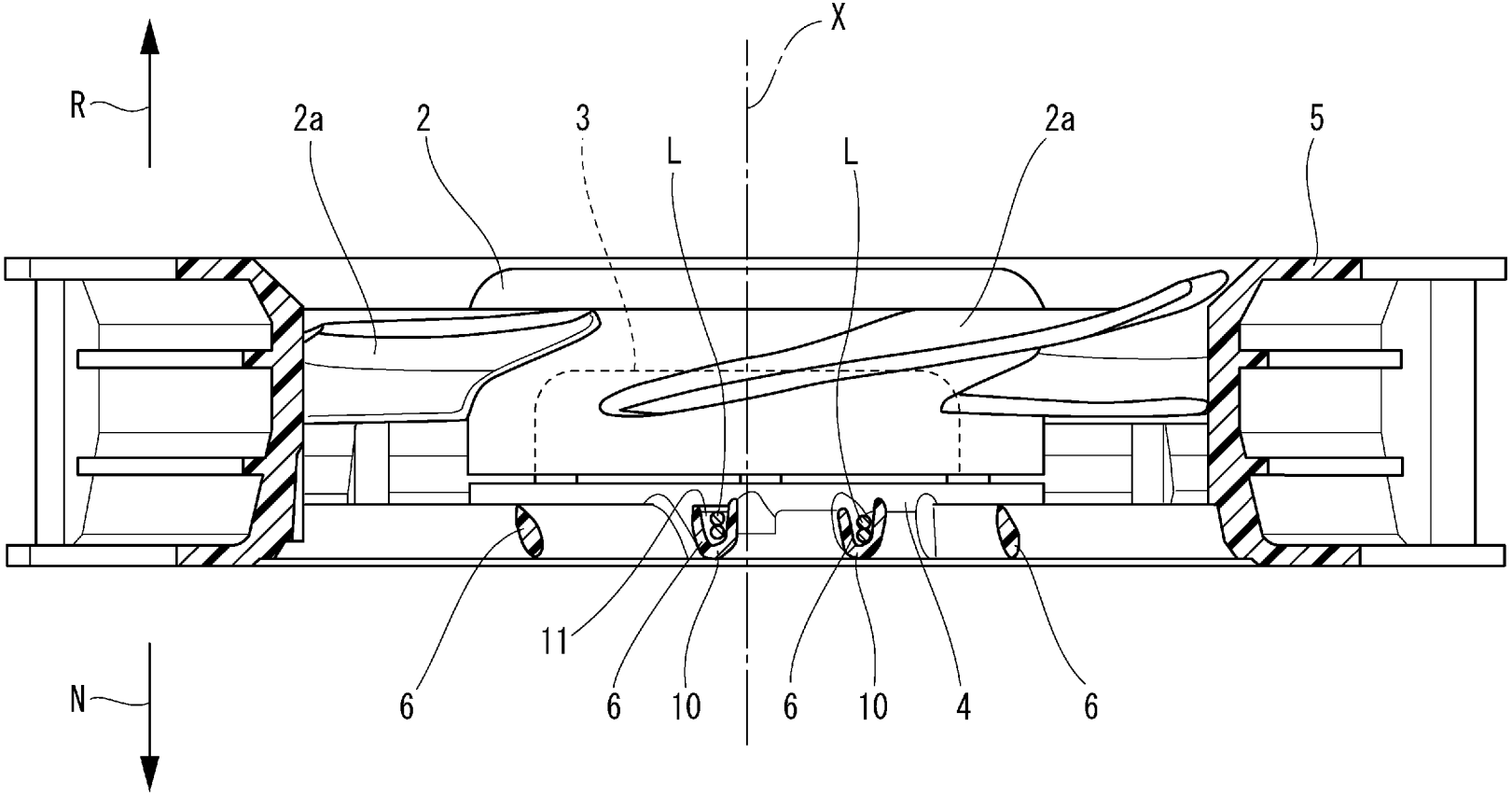
FIG. 2 is a cross-sectional view taken along line A-A in FIG. 1.

FIG. 2 is a cross-sectional view taken along line A-A in FIG. 1. FIG. 3 is a partial enlarged view illustrating the spokes 6 provided with the holding portions 10 and the retaining portions 20.

Figure 3:
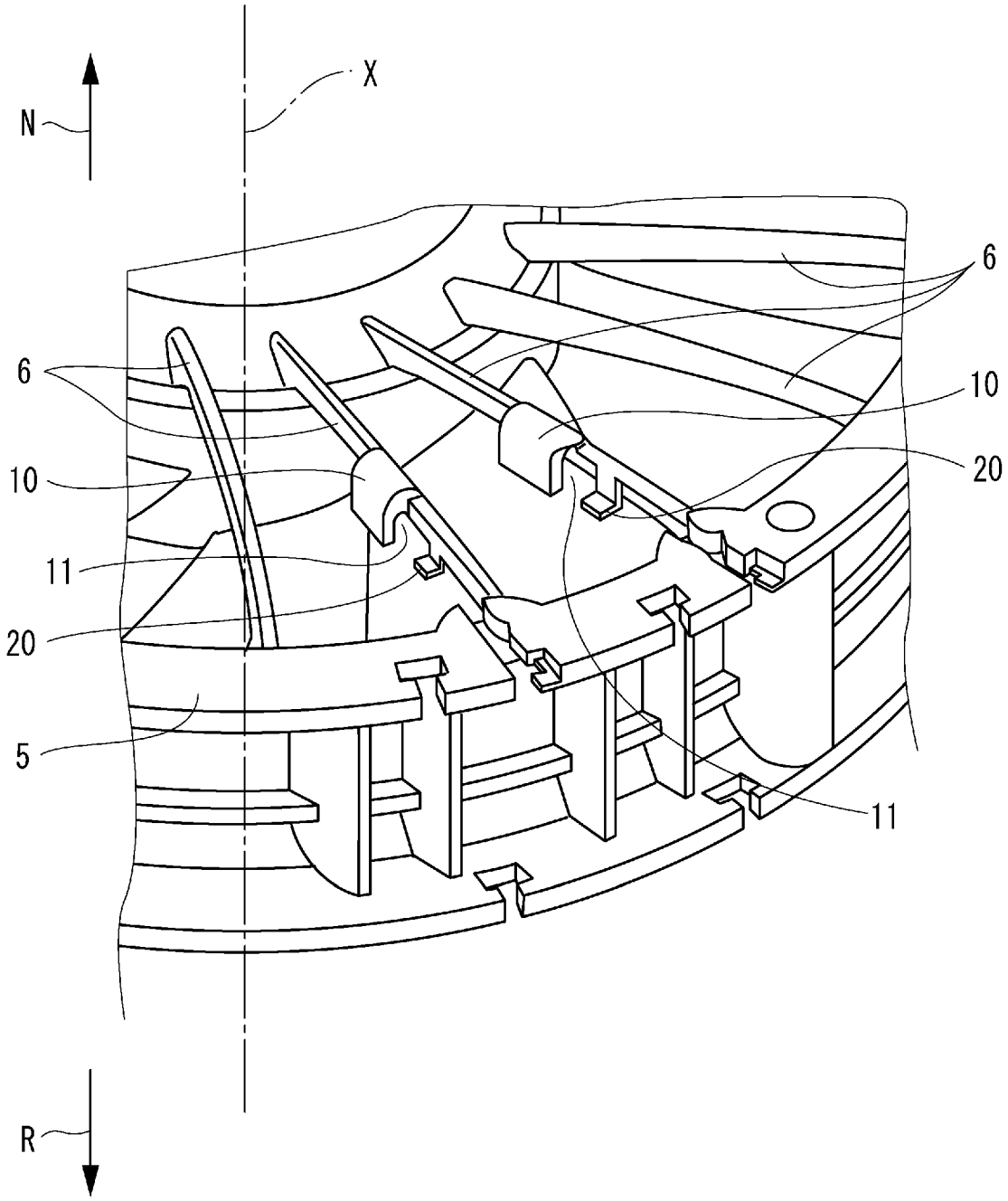
FIG. 3 is a partial enlarged view illustrating holding portions and retaining portions, which are provided to spokes.

As illustrated in FIGS. 2 and 3, the holding portion 10 is provided in such a manner as to jut in a direction intersecting the rotation axis X from a distal end in the normal direction (the direction of the arrow N) of the spoke 6 that is flat in such a manner as to extend along the direction of the rotation axis X. Moreover, the holding portion 10 extends in the reverse direction (the direction of the arrow R). Furthermore, the holding portion 10 has a shape that is convex toward the normal direction.

The holding portion 10 is provided with a housing space 11 for housing a lead wire L for supply of power, the lead wire L being placed along the spoke 6. The holding portion 10 and a side surface of the flat spoke 6 define the housing space 11. The housing space 11 is formed in the form of a groove that opens in the reverse direction. Moreover, the housing space 11 is formed in the form of a groove that extends along the length direction of the spoke 6, that is, in the form of a groove that has a length in the placement direction of the lead wire L to be placed along the spoke 6. The width (the length in the extension direction of the spoke 6) of the holding portion 10 is equal to or greater than 1/10 and less than 1/3 the length of the spoke 6 in the radial direction of the reversible fan 1. The holding portion 10 is provided in such a manner that the part forming the convex shape faces the normal direction side, that is, the opening of the housing space 11 faces the reverse direction side.

Figure 4:
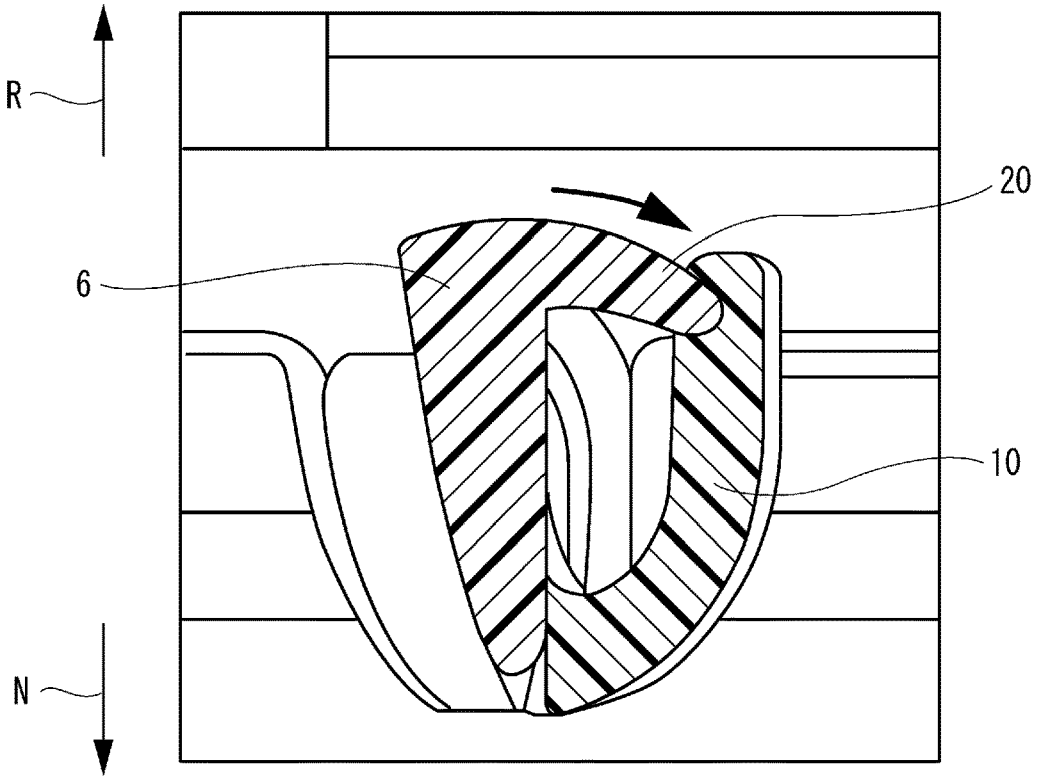
FIG. 4 is a partial enlarged view illustrating the retaining portion provided to the spoke.

FIG. 4 is a partial enlarged view illustrating the retaining portion 20 provided to the spoke 6.

As illustrated in FIGS. 3 and 4, the retaining portion 20 is provided in such a manner as to jut in the direction intersecting the rotation axis X from an end in the reverse direction (the direction of the arrow R) of the spoke 6 that is flat in such a manner as to extend along the direction of the rotation axis X. The retaining portion 20 is a member for restraining the lead wire L housed in the housing space 11 from coming out of the opening of the housing space 11. The retaining portion 20 is provided in such a manner as to be able to surround the lead wire L in cooperation with the holding portion 10.

Figure 5:
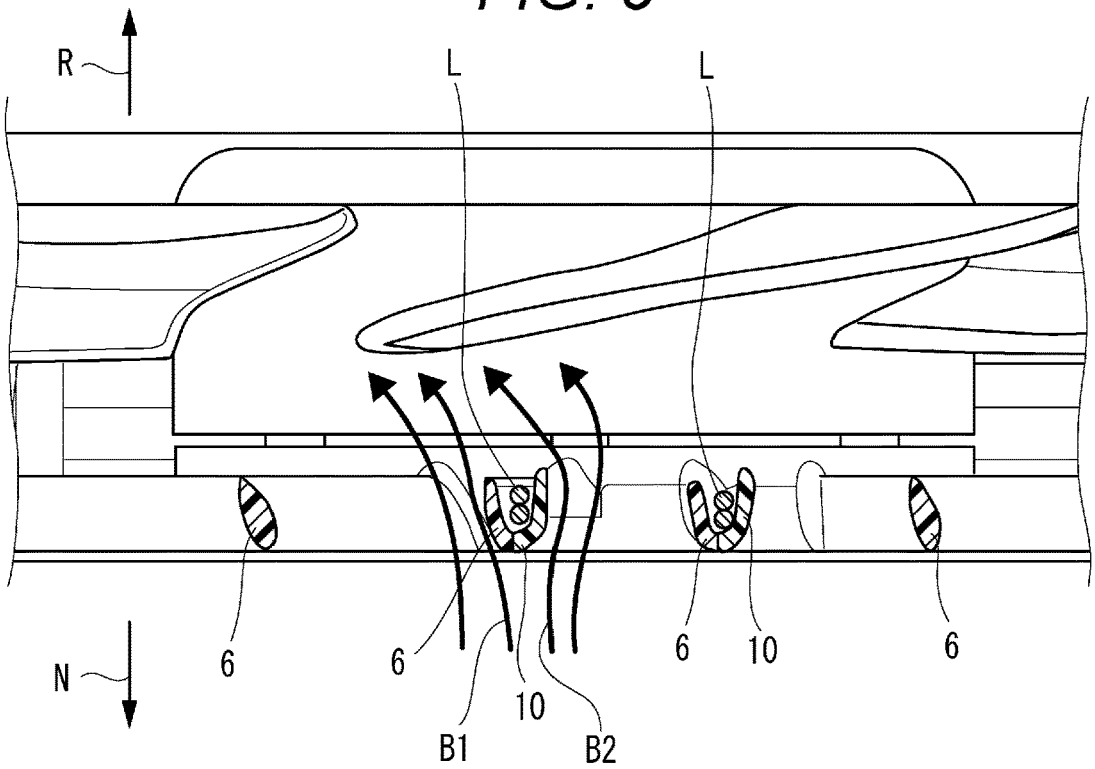
FIG. 5 is a diagram illustrating the flow of wind blowing in the reverse direction.
Figure 6:
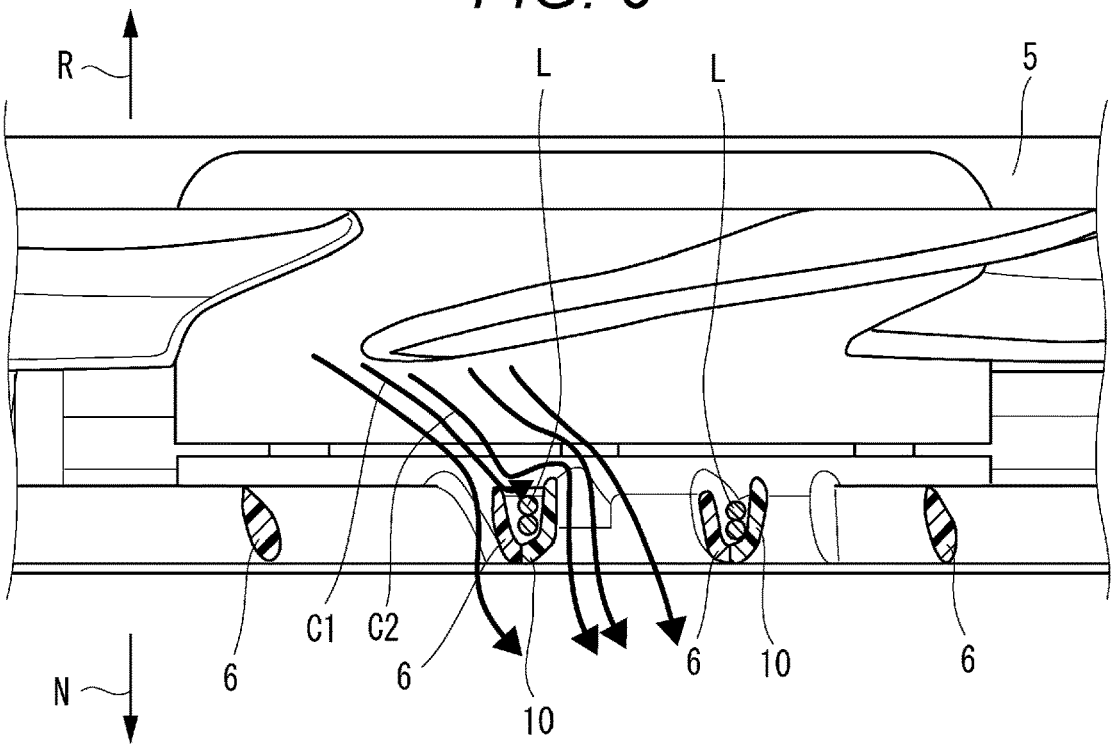
FIG. 6 is a diagram illustrating the flow of wind blowing in the normal direction.

Next, the flow of wind in the reversible fan 1 is described with reference to FIGS. 5 and 6. FIG. 5 is a diagram illustrating the flow of wind blowing in the reverse direction in the reversible fan 1. FIG. 6 is a diagram illustrating the flow of wind blowing in the normal direction in the reversible fan 1.

As illustrated in FIG. 5, when air is blown in the reverse direction in the reversible fan 1, the air that is suctioned through the opening of the frame 5 on the normal direction side moves toward the spoke 6 provided with the holding portion 10 and is taken into the frame 5, hitting the convex shape side of the holding portion 10. Hence, as indicated by, for example, arrows B1 and B2, the air is smoothly taken into the frame 5 along an outer peripheral surface of the holding portion 10 without disturbing the flow. Consequently, the generation of noise due to the obstruction of the flow of air by the holding portion 10 is restrained.

As illustrated in FIG. 6, when air is blown in the normal direction in the reversible fan 1, the air that is suctioned through the opening of the frame 5 on the reverse direction side moves toward the spoke 6 provided with the holding portion 10 and hits the opening side of the holding portion 10 upon being discharged through the opening on the normal direction side. Hence, as indicated by, for example, arrows C1 and C2, the air cannot flow smoothly due to obstruction by the opening of the housing space 11 of the holding portion 10. At this point in time, noise is generated due to the obstruction of the flow of air by the holding portion 10.

Figure 7:
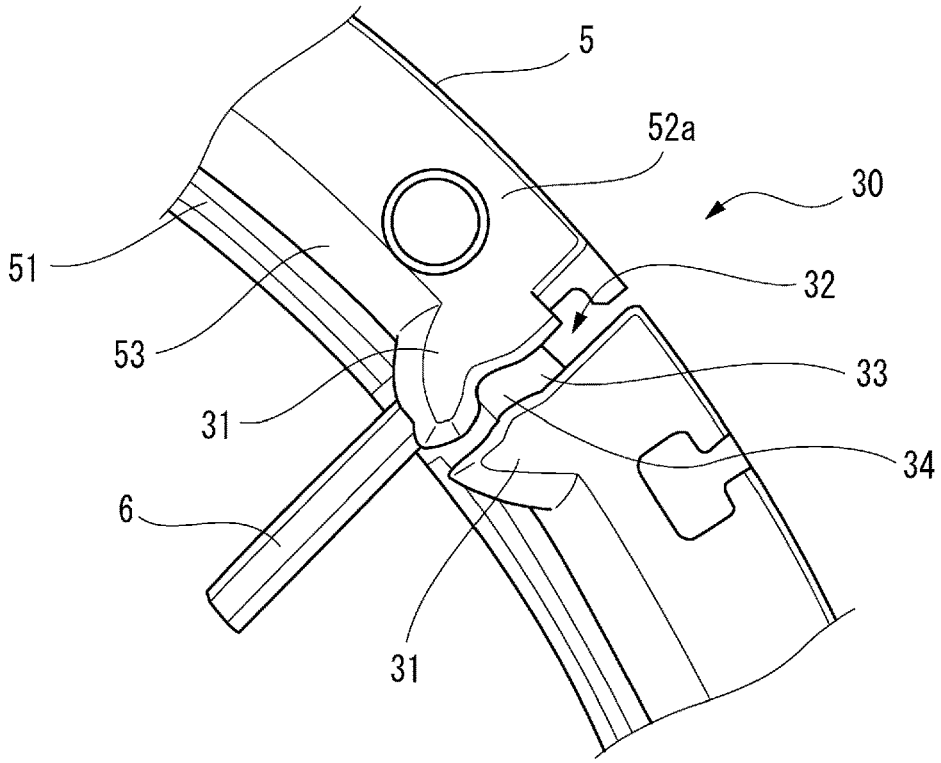
FIG. 7 is a perspective view illustrating a lead wire fixing portion provided to a frame.

FIG. 7 is a perspective view illustrating a lead wire fixing portion 30 provided to the frame 5 of the reversible fan 1. The lead wire fixing portion 30 is a part for further fixing the lead wire L held by the holding portion 10 and the retaining portion 20 of the spoke 6.

As illustrated in FIG. 7, the lead wire fixing portion 30 includes a protruding portion 31 and an attachment groove 32.

The protruding portion 31 is provided on a bottom surface 53 located at an end on the normal direction side of the main body portion 51 of the frame 5. The protruding portion 31 is provided in such a manner as to protrude from the bottom surface 53 toward the base portion 4 (toward the central part of the reversible fan 1).

The attachment groove 32 is provided to the flange portion 52*a* of the frame 5 on the normal direction side. The attachment groove 32 is formed in such a manner as to extend across the flange portion 52*a* in the radial direction. The attachment groove 32 is formed in such a manner as to penetrate the flange portion 52*a* and open into the reverse direction side of the flange portion 52*a*.

The attachment groove 32 is provided in such a manner as to stretch across the flange portion 52*a* from the protruding portion 31. The attachment groove 32 is provided in the approximately central part of the protruding portion 31 in such a manner as to extend in the radial direction. In other words, the attachment groove 32 divides the protruding portion 31 into two in the peripheral direction. The attachment groove 32 includes a straight portion 33 extending in the radial direction, and a bent portion 34 bent in the radial direction. The straight portion 33 is provided in the flange portion 52*a*. The bent portion 34 is provided in the protruding portion 31. The groove of the bent portion 34 is formed with a depth that reaches the bottom surface 53 provided with the protruding portion 31 and also reaches into a part of the main body portion 51 continuous to the bottom surface 53.

The lead wire L held by the holding portion 10 and the retaining portion 20 of the spoke 6 is guided by the bent portion 34 and the straight portion 33 of the attachment groove 32 in such a manner as to be caught on the protruding portion 31. In this manner, the lead wire L is placed through the opening of the flange portion 52*a*.

The embodiment is described in terms of the case where both of the holding portion 10 and the attachment groove 32 are provided to fix the lead wire L. However, the embodiment is not limited to this mode. For example, only one of the holding portion 10 and the attachment groove 32 may be provided. In this case, the lead wire L is fixed only by the holding portion 10, or only by the attachment groove 32.

In the reversible fan 1 according to the embodiment, the holding portion 10 that is configured to hold the lead wire L is provided to the spoke 6. The lead wire L is placed along the spoke 6 to apply power to the motor 3. The housing space 11 where the lead wire L is housed is provided between the holding portion 10 and the spoke 6. The housing space 11 has a groove shape that opens in the reverse direction, and extends along the spoke 6. Hence, when a current of air in the normal direction hits the holding portion 10, the current of air is disturbed by the housing space 11 that opens in the reverse direction, to thus generate noise. In this manner, the noise generated at times of producing a current of air in the normal direction increases. Hence, noise characteristics upon blowing in the normal direction can be brought close to noise characteristics upon blowing in the reverse direction.

Moreover, in the reversible fan 1, the holding portion 10 is formed in such a manner as to protrude in the direction intersecting the rotation axis X from the end on the normal direction side of the spoke 6 of the flat shape extending in the direction along the rotation axis X, and to extend further in the reverse direction. As a result, the holding portion 10 has the convex shape facing in the normal direction. Hence, the current of air that hits the holding portion 10 at times of blowing in the reverse direction can flow smoothly along the convex shape. Hence, the holding portion 10 does not enhance the noise characteristics. As a result, it is easy to match the noise characteristics upon blowing in the normal direction with the noise characteristics upon blowing in the reverse direction.

Moreover, in the reversible fan 1, the holding portion 10 is formed in such a manner that the length along the spoke 6 is equal to or greater than 1/10 and less than 1/3 the radial dimension of the spoke 6. Hence, the lead wire L can be reliably held. In addition, the noise characteristics upon blowing in the normal direction can be brought close to the noise characteristics upon blowing in the reverse direction.

Moreover, in the reversible fan 1, the spoke 6 is provided with the retaining portion 20 configured to restrain the lead wire L housed in the housing space 11 from coming out of the opening. The retaining portion 20 protrudes in the direction intersecting the rotation axis X from the end of the spoke 6 in the reverse direction. Hence, the retaining portion 20, together with the holding portion 10, can surround the lead wire L. Hence, it is possible to further restrain the lead wire L housed in the housing space 11 from coming out.

Moreover, in the reversible fan 1, the bottom surface 53, which is located at the end of the main body portion 51 on the normal direction side, of the frame 5 is provided with the protruding portion 31 protruding toward the base portion 4. Furthermore, the attachment groove 32 configured to fix the lead wire L is provided. The attachment groove 32 extends in the radial direction in such a manner as to stretch across the flange portion 52*a* from the protruding portion 31. The attachment groove 32 is formed in the flange portion 52*a* in such a manner as to open in the reverse direction. Furthermore, the attachment groove 32 includes the bent portion 34 bent in the radial direction, in the protruding portion 31. Hence, the size of the flange portion 52*a* can be changed while the shapes of the bent portion 34 and the protruding portion 31 are maintained. Hence, the frame 5 of a different size can be easily designed. Hence, the application of the reversible fan can easily cover and extend the range of sizes.

Up to this point the embodiment has been described. However, it is needless to say that the technical scope of the embodiment should not be construed in a limited manner by the description of the above-mentioned embodiment. The embodiment is a mere example. Those skilled in the art understand that the embodiment can be modified in various manners within the scope of the disclosure described in the claims. The technical scope of the present disclosure should be determined on the basis of the scope disclosed in the claims and the scope of equivalents thereof.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A reversible fan that produces a current of air in both of a normal direction and a reverse direction, the reversible fan comprising:

an impeller configured to be rotatable about a rotation axis;

a motor configured to rotate the impeller;

a base portion supporting the motor;

a tubular frame housing the impeller, the motor, and the base portion;

a spoke extending from an inner peripheral surface of the tubular frame toward the rotation axis, the spoke supporting the base portion; and a holding portion configured to hold at least a part of a lead wire provided along the spoke to apply power to the motor, wherein the holding portion is provided with a housing space opening in the reverse direction and extending along the spoke.

2. The reversible fan according to claim 1, wherein the holding portion has a shape being convex toward the normal direction.

3. The reversible fan according to claim 1, wherein the spoke has a flat cross-sectional shape extending in a direction substantially along the rotation axis, and the holding portion juts in a direction intersecting the rotation axis from an end of the spoke in the normal direction, and extends in the reverse direction.

4. The reversible fan according to claim 1, wherein the spoke is provided with a retaining portion configured to restrain the lead wire housed in the housing space from coming out of the opening.

5. The reversible fan according to claim 4, wherein the retaining portion juts in a direction intersecting the rotation axis from an end of the spoke in the reverse direction.

6. The reversible fan according to claim 1, wherein the holding portion has a length that is equal to or greater than 1/10 and less than 1/3 the radial dimension of the spoke.

7. The reversible fan according to claim 1, wherein the tubular frame includes a main body portion forming a tubular part, and a flange portion provided on an outer region of the main body portion, a first bottom surface located at a first end of the main body portion in the normal direction is provided with a protruding portion protruding toward the base portion, a second bottom surface located at a second end of the tubular frame in the normal direction is provided with an attachment groove configured to fix the lead wire, and the attachment groove extends in a radial direction, opens in the reverse direction, and is provided at a position stretching across the flange portion from the protruding portion.

8. The reversible fan according to claim 7, wherein the attachment groove includes a straight portion extending in the radial direction, and a bent portion bent in the radial direction, and the bent portion is provided in the protruding portion.

* * * * *